US009021832B2

(12) United States Patent
Pierce et al.

(10) Patent No.: US 9,021,832 B2
(45) Date of Patent: May 5, 2015

(54) HYDROCARBON GAS PROCESSING

(75) Inventors: Michael C. Pierce, Erie, CO (US); John D. Wilkinson, Midland, TX (US); Hank M. Hudson, Midland, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 480 days.

(21) Appl. No.: 12/979,563

(22) Filed: Dec. 28, 2010

(65) Prior Publication Data

US 2011/0167868 A1 Jul. 14, 2011

Related U.S. Application Data

(60) Provisional application No. 61/295,119, filed on Jan. 14, 2010.

(51) Int. Cl.
*F25J 3/02* (2006.01)

(52) U.S. Cl.
CPC ..... *F25J 3/0209* (2013.01); *F25J 3/0219* (2013.01); *F25J 3/0233* (2013.01); *F25J 3/0238* (2013.01); *F25J 2200/04* (2013.01); *F25J 2200/70* (2013.01); *F25J 2200/72* (2013.01); *F25J 2200/74* (2013.01); *F25J 2200/78* (2013.01); *F25J 2205/04* (2013.01); *F25J 2210/12* (2013.01); *F25J 2230/30* (2013.01);

(Continued)

(58) Field of Classification Search
USPC ..... 62/620, 628, 618, 611, 621, 630, 632
See application file for complete search history.

(56) References Cited

U.S. PATENT DOCUMENTS 2,880,592 A 4/1959 Davison et al.
2,952,984 A 9/1960 Marshall, Jr.

(Continued)

FOREIGN PATENT DOCUMENTS

EP 0 182 643 A2 5/1986
EP 1 114 808 A1 7/2001

(Continued)

OTHER PUBLICATIONS

B.C. Price et al., "LNG Production for Peak Shaving Operations", Proceedings of the Seventy-eighth Annual Convention of the Gas Processors Association, Nashville, Tennessee, Mar. 1-3, 1999, 8 sheets.

(Continued)

*Primary Examiner* — John Pettitt
(74) *Attorney, Agent, or Firm* — Fitzpatrick, Cella, Harper & Scinto

(57) ABSTRACT

A process and an apparatus are disclosed for recovering ethane, ethylene, and heavier hydrocarbon components from a hydrocarbon gas stream. The stream is cooled, expanded to lower pressure, and supplied to a first fractionation tower at a mid-column feed position. A distillation liquid stream is withdrawn from the first fractionation tower below the feed position of the expanded stream, heated, and directed into a second fractionation tower that produces an overhead vapor stream and a bottom liquid stream. The overhead vapor stream is cooled to condense it, with a portion of the condensed stream directed to the second fractionation tower as its top feed and the remainder directed to the first fractionation tower at a lower column feed position. The bottom liquid stream from the second fractionation tower is cooled and directed to the first fractionation tower as its top feed.

16 Claims, 2 Drawing Sheets

Figure 1:
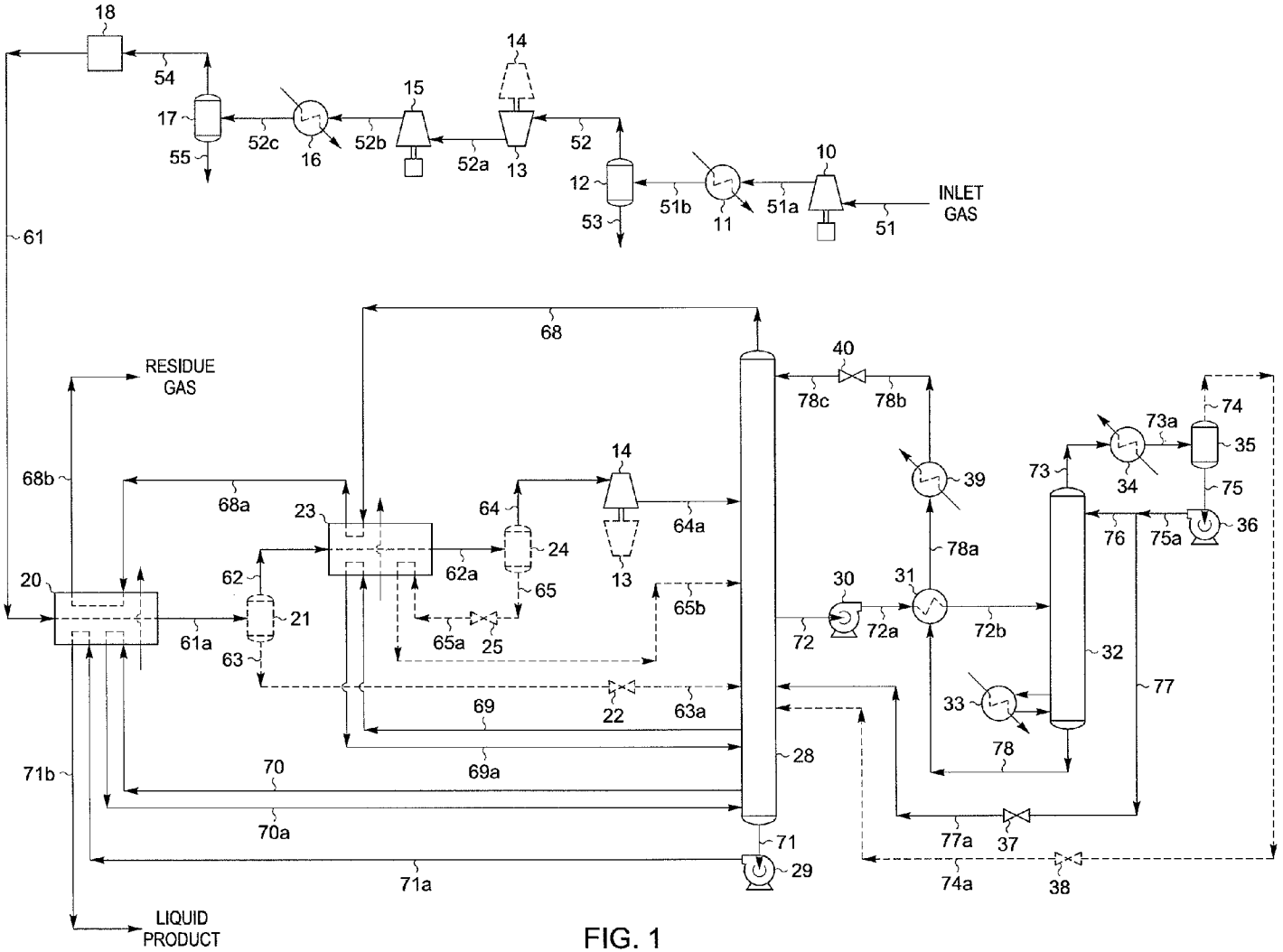

(52) U.S. Cl.
CPC ..... *F25J2235/60* (2013.01); *F25J 2240/02* (2013.01); *F25J 2245/02* (2013.01); *F25J 2270/12* (2013.01); *F25J 2270/60* (2013.01)

(56) References Cited

U.S. PATENT DOCUMENTS 3,292,380 A 12/1966 Bucklin
3,507,127 A 4/1970 De Marco
3,516,261 A 6/1970 Hoffman
3,524,897 A 8/1970 Kniel
3,656,311 A 4/1972 Kaiser
3,675,435 A 7/1972 Jackson et al.
3,837,172 A 9/1974 Markbreiter et al.
3,902,329 A 9/1975 King, III et al.
3,920,767 A * 11/1975 Carter ..... 585/331
3,983,711 A 10/1976 Solomon
4,002,042 A 1/1977 Pryor et al.
4,004,430 A 1/1977 Solomon et al.
4,061,481 A 12/1977 Campbell et al.
4,115,086 A 9/1978 Jordan et al.
4,132,604 A 1/1979 Alexion et al.
4,140,504 A 2/1979 Campbell et al.
4,157,904 A 6/1979 Campbell et al.
4,171,964 A 10/1979 Campbell et al.
4,185,978 A 1/1980 McGalliard et al.
4,203,741 A 5/1980 Bellinger et al.
4,251,249 A 2/1981 Gulsby
4,278,457 A 7/1981 Campbell et al.
4,284,423 A 8/1981 Eakman et al.
4,318,723 A 3/1982 Holmes et al.
4,322,225 A 3/1982 Bellinger et al.
4,356,014 A 10/1982 Higgins
4,445,917 A 5/1984 Chiu
4,507,133 A 3/1985 Khan et al.
4,519,824 A 5/1985 Huebel
4,525,185 A 6/1985 Newton
4,545,795 A 10/1985 Liu et al.
4,592,766 A 6/1986 Kumman et al.
4,596,588 A 6/1986 Cook
4,600,421 A 7/1986 Kummann
4,617,039 A 10/1986 Buck
4,657,571 A 4/1987 Gazzi
4,687,499 A 8/1987 Aghili
4,689,063 A 8/1987 Paradowski et al.
4,690,702 A 9/1987 Paradowski et al.
4,698,081 A 10/1987 Aghili
4,705,549 A 11/1987 Sapper
4,707,170 A 11/1987 Ayres et al.
4,710,214 A 12/1987 Sharma et al.
4,711,651 A 12/1987 Sharma et al.
4,718,927 A 1/1988 Bauer et al.
4,738,699 A 4/1988 Apffel
4,746,342 A 5/1988 DeLong et al.
4,755,200 A 7/1988 Liu et al.
4,851,020 A 7/1989 Montgomery, IV
4,854,955 A 8/1989 Campbell et al.
4,869,740 A 9/1989 Campbell et al.
4,889,545 A 12/1989 Campbell et al.
4,895,584 A 1/1990 Buck et al.
RE33,408 E 10/1990 Khan et al.
4,966,612 A 10/1990 Bauer
5,114,451 A 5/1992 Rambo et al.
5,275,005 A 1/1994 Campbell et al.
5,291,736 A 3/1994 Paradowski
5,335,504 A 8/1994 Durr et al.
5,363,655 A 11/1994 Kikkawa et al.
5,365,740 A 11/1994 Kikkawa et al.
5,546,764 A 8/1996 Mehra
5,555,748 A 9/1996 Campbell et al.
5,566,554 A 10/1996 Vijayaraghavan et al.
5,568,737 A 10/1996 Campbell et al.
5,600,969 A 2/1997 Low
5,615,561 A 4/1997 Houshmand et al.
5,651,269 A 7/1997 Prevost et al.
5,675,054 A 10/1997 Manley et al.
5,685,170 A 11/1997 Sorensen
5,755,114 A 5/1998 Foglietta
5,755,115 A 5/1998 Manley
5,771,712 A 6/1998 Campbell et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,893,274 A 4/1999 Nagelvoort et al.
5,970,742 A * 10/1999 Agrawal et al. ..... 62/630
5,983,664 A 11/1999 Campbell et al.
5,992,175 A 11/1999 Yao et al.
6,014,869 A 1/2000 Elion et al.
6,023,942 A 2/2000 Thomas et al.
6,053,007 A 4/2000 Victory et al.
6,062,041 A 5/2000 Kikkawa et al.
6,116,050 A 9/2000 Yao et al.
6,119,479 A 9/2000 Roberts et al.
6,125,653 A 10/2000 Shu et al.
6,182,469 B1 2/2001 Campbell et al.
6,237,365 B1 5/2001 Trebble
6,244,070 B1 6/2001 Lee et al.
6,250,105 B1 6/2001 Kimble
6,269,655 B1 8/2001 Roberts et al.
6,272,882 B1 8/2001 Hodges et al.
6,308,531 B1 10/2001 Roberts et al.
6,324,867 B1 12/2001 Fanning et al.
6,336,344 B1 1/2002 O'Brien
6,347,532 B1 2/2002 Agrawal et al.
6,361,582 B1 3/2002 Pinnau et al.
6,363,744 B2 4/2002 Finn et al.
6,367,286 B1 4/2002 Price
6,417,420 B1 * 7/2002 Stewart et al. ..... 585/323
6,453,698 B2 9/2002 Jain et al.
6,516,631 B1 2/2003 Trebble
6,526,777 B1 3/2003 Campbell et al.
6,550,274 B1 * 4/2003 Agrawal ..... 62/617
6,564,579 B1 5/2003 McCartney
6,565,626 B1 5/2003 Baker et al.
6,578,379 B2 6/2003 Paradowski
6,604,380 B1 8/2003 Reddick et al.
6,694,775 B1 2/2004 Higginbotham et al.
6,712,880 B2 3/2004 Foglietta et al.
6,742,358 B2 6/2004 Wilkinson et al.
6,889,523 B2 5/2005 Wilkinson et al.
6,907,752 B2 6/2005 Schroeder et al.
6,915,662 B2 7/2005 Wilkinson et al.
6,941,771 B2 9/2005 Reddick et al.
6,945,075 B2 9/2005 Wilkinson et al.
7,069,743 B2 7/2006 Prim
7,155,931 B2 1/2007 Wilkinson et al.
7,159,417 B2 1/2007 Foglietta et al.
7,165,423 B2 1/2007 Winningham
7,191,617 B2 3/2007 Cuellar et al.
7,210,311 B2 5/2007 Wilkinson et al.
7,216,507 B2 5/2007 Cuellar et al.
7,219,513 B1 5/2007 Mostafa
7,273,542 B2 9/2007 Duhon et al.
7,631,516 B2 12/2009 Cuellar et al.
7,714,180 B2 5/2010 Duhon et al.
8,590,340 B2 11/2013 Pitman et al.
2002/0166336 A1 11/2002 Wilkinson et al.
2004/0079107 A1 4/2004 Wilkinson et al.
2004/0172967 A1 9/2004 Patel et al.
2005/0204774 A1 9/2005 Foglietta et al.
2005/0229634 A1 10/2005 Huebel et al.
2005/0247078 A1 11/2005 Wilkinson et al.
2005/0268649 A1 12/2005 Wilkinson et al.
2006/0032269 A1 2/2006 Cuellar et al.
2006/0086139 A1 4/2006 Eaton et al.
2006/0283207 A1 12/2006 Pitman et al.
2007/0231244 A1 10/2007 Shah et al.
2008/0000265 A1 1/2008 Cuellar et al.
2008/0078205 A1 4/2008 Cuellar et al.
2008/0141712 A1 * 6/2008 Verma ..... 62/620
2008/0271480 A1 11/2008 Mak
2008/0282731 A1 11/2008 Cuellar et al.
2009/0100862 A1 4/2009 Wilkinson et al.
2009/0107174 A1 4/2009 Ambari et al.

(56) References Cited

U.S. PATENT DOCUMENTS

| | | | |
|---|---|---|---|
| 2009/0107175 | A1 | 4/2009 | Patel et al. |
| 2009/0113930 | A1 | 5/2009 | Patel et al. |
| 2009/0282865 | A1 | 11/2009 | Martinez et al. |
| 2010/0236285 | A1 | 9/2010 | Johnke et al. |
| 2010/0251764 | A1 | 10/2010 | Johnke et al. |
| 2010/0275647 | A1 | 11/2010 | Johnke et al. |
| 2010/0287982 | A1 | 11/2010 | Martinez et al. |
| 2010/0287983 | A1 | 11/2010 | Johnke et al. |
| 2010/0287984 | A1 | 11/2010 | Johnke et al. |
| 2010/0326134 | A1 | 12/2010 | Johnke et al. |
| 2011/0067441 | A1 | 3/2011 | Martinez et al. |
| 2011/0067442 | A1 | 3/2011 | Martinez et al. |
| 2011/0067443 | A1 | 3/2011 | Martinez et al. |
| 2011/0226011 | A1 | 9/2011 | Johnke et al. |
| 2011/0226012 | A1 | 9/2011 | Johnke et al. |
| 2011/0226013 | A1 | 9/2011 | Johnke et al. |
| 2011/0226014 | A1 | 9/2011 | Johnke et al. |
| 2011/0232328 | A1 | 9/2011 | Johnke et al. |
| 2011/0296867 | A1 | 12/2011 | Cuellar et al. |
| 2013/0125582 | A1 | 5/2013 | Martinez et al. |

FOREIGN PATENT DOCUMENTS

| | | | |
|---|---|---|---|
| GB | 2102931 | A | 2/1983 |
| WO | 99/23428 | A1 | 5/1999 |
| WO | 99/37962 | A1 | 7/1999 |
| WO | 00/33006 | A1 | 6/2000 |
| WO | 00/34724 | A1 | 6/2000 |
| WO | 01/88447 | A1 | 11/2001 |
| WO | 02/14763 | A1 | 2/2002 |
| WO | 2004/076946 | A2 | 9/2004 |
| WO | 2007/001669 | A2 | 1/2007 |
| WO | 2009/010558 | A2 | 1/2009 |

OTHER PUBLICATIONS

Fig. 16-33, on p. 16-24 of the Engineering Data Book, Twelfth Edition, published by the Gas Processors Suppliers Association 2004.

Finn et al., "LNG Technology for Offshore and Mid-scale Plants", Proceedings of the Seventy-ninth Annual Convention of the Gas Processors Association, Atlanta, Georgia, Mar. 13-15, 2003, 23 sheets.

Kikkawa et al., "Optimize the Power System of Baseload LNG Plant", Proceedings of the Eightieth Annual Convention of the Gas Processors Association, San Antonio, Texas, Mar. 12-14, 2001, 23 sheets.

International Search Report issued in International Application No. PCT/US2010/062402 dated Feb. 25, 2011—1 page.

Written Opinion issued in International Application No. PCT/US2010/062402 dated Feb. 25, 2011—10 pages.

Mowrey, E. Ross., "Efficient, High Recovery of Liquids from Natural Gas Utilizing a High Pressure Absorber," Proceedings of the Eighty-First Annual Convention of the Gas Processors Association, Dallas, Texas, Mar. 11-13, 2002—10 pages.

"Dew Point Control Gas Conditioning Units," SME Products Brochure, Gas Processors Assoc. Conference (Apr. 5, 2009)—2 pages.

"Fuel Gas Conditioning Units for Compressor Engines," SME Products Brochure, Gas Processors Assoc. Conference (Apr. 5, 2009)—2 pages.

"P&ID Fuel Gas Conditioner," Drawing No. SMEP-901, Date Drawn: Aug. 29, 2007, SME, available at http://www.sme-llc.com/sme.cfm?a=prd&catID=58&subID=44&prdID=155 (Apr. 24, 2009)—1 page.

"Fuel Gas Conditioner Preliminary Arrangement," Drawing No. SMP-1007-00, Date Drawn: Nov. 11, 2008, SME, available at http://www.sme-llc.com/sme.cfm?a=prd&catID=58&subID=44&prdID=155 (Apr. 24, 2009)—2 pages.

"Product: Fuel Gas Conditioning Units," SME Associates, LLC, available at http://www.smellc.com/sme.cfm?a=prd&catID=58&subID=44&prdID=155 (Apr. 24, 2009)—1 page.

* cited by examiner

HYDROCARBON GAS PROCESSING

The applicants claim the benefits under Title 35, U.S. Code, Section 119(*e*) of prior U.S. Provisional Application No. 61/295,119 which was filed on Jan. 14, 2010.

BACKGROUND OF THE INVENTION

This invention relates to a process for the separation of a hydrocarbon bearing gas stream containing significant quantities of components more volatile than methane (e.g., hydrogen, nitrogen, etc.) into two fractions: a first fraction containing predominantly methane and the more volatile components, and a second fraction containing the recovered desirable ethane/ethylene and heavier hydrocarbon components.

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Hydrocarbon bearing gas typically contains components more volatile than methane (e.g., hydrogen, nitrogen, etc.) and often unsaturated hydrocarbons (e.g., ethylene, propylene, etc.) and aromatic hydrocarbons (e.g., benzene, toluene, etc.) in addition to methane, ethane, and hydrocarbons of higher molecular weight such as propane, butane, and pentane. Sulfur-containing gases and carbon dioxide are also sometimes present.

The present invention is generally concerned with the recovery of ethylene, ethane, and heavier ($C_2$+) hydrocarbons from such gas streams. Recent changes in ethylene demand have created increased markets for ethylene and derivative products. In addition, fluctuations in the prices of both natural gas and its natural gas liquid (NGL) constituents have increased the value of ethane and heavier components as liquid products. These market conditions have resulted in the demand for processes which can provide high ethylene and ethane recovery and more efficient recovery of all these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412; 11/839,693; 11/971,491; 12/206,230; 12/689,616; 12/717,394; 12/750,862; 12/772,472; 12/781,259; 12/868,993; 12/869,007; and 12/869,139 describe relevant processes (although the description of the present invention in some cases is based on different processing conditions than those described in the cited U.S. patents and applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, hydrogen, nitrogen, and other volatile gases as overhead vapor from the desired $C_2$ components, $C_3$ components, and heavier hydrocarbon components as bottom liquid product, or to separate residual methane, $C_2$ components, hydrogen, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

In the ideal operation of such a separation process, the residue gas leaving the process will contain substantially all of the methane and more volatile components in the feed gas with essentially none of the heavier hydrocarbon components, and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of ethylene and ethane occur because the top liquid feed contains substantial quantities of $C_2$+ components and heavier hydrocarbon components, resulting in corresponding equilibrium quantities of $C_2$+ components in the vapors leaving the top fractionation stage of the demethanizer. This problem is exacerbated if the gas stream(s) being processed contain relatively large quantities of components more volatile than methane (e.g., hydrogen, nitrogen, etc.) because the volatile vapors rising up the column strip $C_2$+ components from the liquids flowing downward. The loss of these desirable $C_2$+ components could be significantly reduced if the rising vapors could be brought into contact with a significant quantity of liquid (reflux) capable of absorbing the $C_2$+ components from the vapors.

A number of processes have been developed to use a cold liquid that is predominantly methane as the reflux stream to contact the rising vapors in a rectification section in the distillation column. Typical process schemes of this type are disclosed in U.S. Pat. Nos. 4,889,545; 5,568,737; and 5,881,569, and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. Unfortunately, these processes require the use of a compressor to provide the motive force for recycling the reflux stream to the demethanizer, adding to both the capital cost and the operating cost of facilities using these processes. In addition, the cold methane reflux creates temperatures within the distillation column that are −112° F. [−80° C.] and colder. Many gas streams of this type contain significant quantities of nitrous oxides ($NO_X$) at times, which can accumulate in cold sections of a processing plant as $NO_X$ gums (commonly referred to as "blue ice") at temperatures lower than this. "Blue ice" can become explosive upon warming, and has been identified as the cause of a number of deflagrations and/or explosions in processing plants.

Other processes have been developed that use a heavy ($C_4$-$C_{10}$ typically) hydrocarbon absorbent stream to reflux the distillation column. Examples of processes of this type are U.S. Pat. Nos. 4,318,723; 5,546,764; 7,273,542; and 7,714,180. While such processes generally operate at temperatures warm enough to avoid concerns about "blue ice", the absorbent stream is typically produced from the distillation column bottoms stream, with the result that any aromatic hydrocarbons present in the feed gas will concentrate in the distillation column. Aromatic hydrocarbons such as benzene can freeze solid at normal processing temperatures, causing frequent disruptions in the processing plant.

In accordance with the present invention, it has been found that ethane recovery in excess of 88% can be obtained without requiring any temperatures to be lower than −112° F. [−80° C.]. The present invention is particularly advantageous when processing feed gases containing more than 10 mole % of components more volatile than methane.

Figure 2:
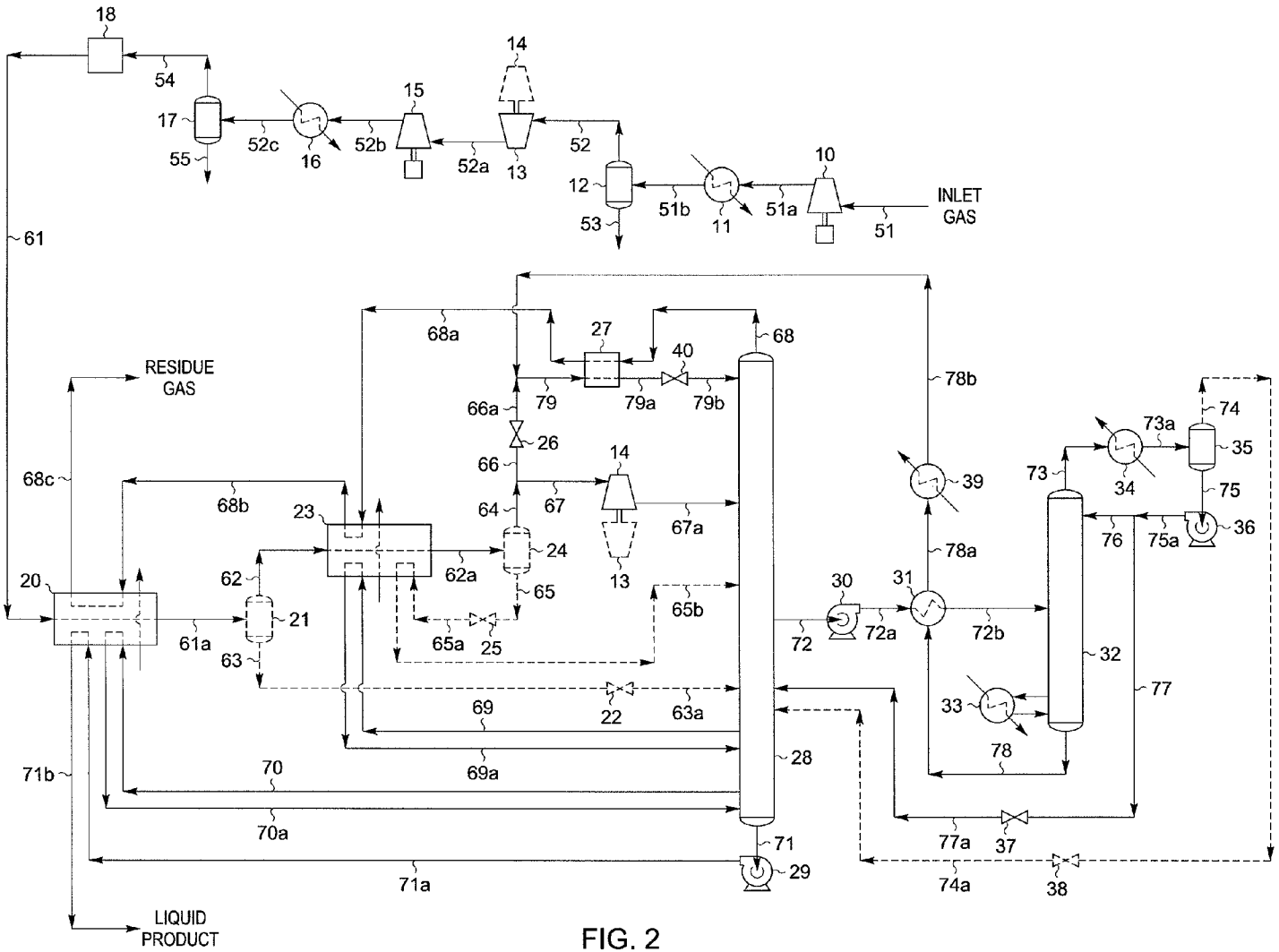

For a better understanding of the present invention, reference is made to the following examples and drawings. Referring to the drawings:

FIG. 1 is a flow diagram of gas processing plant in accordance with the present invention; and FIG. 2 is a flow diagrams illustrating alternative means of application of the present invention to a gas stream.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE INVENTION

FIG. 1 illustrates a flow diagram of a process in accordance with the present invention. In the simulation of the FIG. 1 process, inlet gas enters the plant at 100° F. [38° C.] and 77 psia [531 kPa(a)] as stream 51 If the inlet gas contains a concentration of sulfur compounds and/or carbon dioxide which would prevent the product streams from meeting specifications, the sulfur compounds and/or carbon dioxide are removed by appropriate pretreatment of the feed gas (not illustrated).

The inlet gas is compressed to higher pressure in three stages before processing (compressors 10 and 15 driven by an external power source and compressor 13 driven by work expansion machine 14). Discharge coolers 11 and 16 are used to cool the gas between stages, and separators 12 and 17 are used to remove any water or other liquids that condense from the gas stream as it is cooled. The cooled compressed gas stream 54 leaving separator 17 is dehydrated in dehydration unit 18 to prevent hydrate (ice) formation under cryogenic conditions. Solid desiccant has typically been used for this purpose.

The dehydrated gas stream 61 at 100° F. [38° C.] and 560 psia [3,859 kPa(a)] enters heat exchanger 20 and is cooled by heat exchange with cool residue gas (stream 68*a*), liquid product at 28° F. [−2° C.] (stream 71*a*), demethanizer reboiler liquids at 13° F. [−11° C.] (stream 70), and propane refrigerant. Note that in all cases exchanger 20 is representative of either a multitude of individual heat exchangers or a single multi-pass heat exchanger, or any combination thereof (The decision as to whether to use more than one heat exchanger for the indicated cooling services will depend on a number of factors including, but not limited to, inlet gas flow rate, heat exchanger size, stream temperatures, etc.) The cooled stream 61*a* enters separator 21 at 40° F. [4° C.] and 550 psia [3,790 kPa(a)] where the vapor (stream 62) is separated from the condensed liquid (stream 63). The separator liquid (stream 63) is expanded to the operating pressure (approximately 175 psia [1,207 kPa(a)]) of fractionation tower 28 by expansion valve 22, cooling stream 63*a* to 16° F. [−9° C.] before it is supplied to fractionation tower 28 at a lower column feed point.

The vapor (stream 62) from separator 21 is further cooled in heat exchanger 23 by heat exchange with cold residue gas (stream 68), demethanizer side reboiler liquids at −10° F. [−23° C.] (stream 69), flashed liquids (stream 65*a*), and propane refrigerant. The cooled stream 62*a* enters separator 24 at −42° F. [−41° C.] and 535 psia [3,686 kPa(a)] where the vapor (stream 64) is separated from the condensed liquid (stream 65). The separator liquid (stream 65) is expanded to slightly above the tower operating pressure by expansion valve 25, cooling stream 65*a* to −63° F. [−53° C.] before it is heated to −40° F. [−40° C.] in heat exchanger 23. The heated stream 65*b* is then supplied to fractionation tower 28 at a lower mid-column feed point.

The vapor (stream 64) from separator 24 enters work expansion machine 14 in which mechanical energy is extracted from this portion of the high pressure feed. The machine 14 expands the vapor substantially isentropically to the tower operating pressure, with the work expansion cooling the expanded stream 64*a* to a temperature of approximately −105° F. [−76° C.]. The typical commercially available expanders are capable of recovering on the order of 80-85% of the work theoretically available in an ideal isentropic expansion. The work recovered is often used to drive a centrifugal compressor (such as item 13) that can be used to compress the inlet gas (stream 52), for example. The partially condensed expanded stream 64*a* is thereafter supplied as feed to fractionation tower 28 at an upper mid-column feed point.

The demethanizer in tower 28 is a conventional distillation column containing a plurality of vertically spaced trays, one or more packed beds, or some combination of trays and packing. The demethanizer tower consists of two sections: an upper absorbing (rectification) section that contains the trays and/or packing to provide the necessary contact between the vapor portion of the expanded stream 64*a* rising upward and cold liquid falling downward to condense and absorb the $C_2$ components, $C_3$ components, and heavier components from the vapors rising upward; and a lower, stripping (demethanizing) section that contains the trays and/or packing to provide the necessary contact between the liquids falling downward and the vapors rising upward. The demethanizing section also includes one or more reboilers (such as the reboiler and side reboiler described previously) which heat and vaporize a portion of the liquids flowing down the column to provide the stripping vapors which flow up the column to strip the liquid product, stream 71, of methane and lighter components. Stream 64*a* enters demethanizer 28 at an intermediate feed position located in the lower region of the absorbing section of demethanizer 28. The liquid portion of the expanded stream commingles with liquids falling downward from the absorbing section and the combined liquid continues downward into the stripping section of demethanizer 28. The vapor portion of the expanded stream rises upward through the absorbing section and is contacted with cold liquid falling downward to condense and absorb the $C_2$ components, $C_3$ components, and heavier components.

A portion of the distillation liquid (stream 72) is withdrawn from an intermediate region of the stripping section in fractionation column 28, below the feed position of expanded stream 64*a* in the lower region of the absorbing section but above the feed position of expanded liquid stream 63*a* in the stripping section. Withdrawing the distillation liquid at this location provides a liquid stream that is predominantly $C_2$-$C_5$ hydrocarbons containing very little of the volatile components (e.g., methane, hydrogen, nitrogen, etc.) and little of the aromatic hydrocarbons and heavier hydrocarbon components. This distillation vapor stream 72 is pumped to higher pressure by pump 30 (stream 72*a*) and then heated from −25° F. [−32° C.] to 77° F. [25° C.] and partially vaporized in heat exchanger 31 by heat exchange with the hot depropanizer bottom stream 78. The heated stream 72*b* then enters depropanizer 32 (operating at 265 psia [1,828 kPa(a)]) at a mid-column feed point.

The depropanizer in tower 32 is a conventional distillation column containing a plurality of vertically spaced trays, one or more packed beds, or some combination of trays and packing. The depropanizer tower consists of two sections: an upper absorbing (rectification) section that contains the trays and/or packing to provide the necessary contact between the vapor portion of the heated stream 72*b* rising upward and cold liquid falling downward to condense and absorb the $C_4$ components and heavier components; and a lower, stripping (depropanizing) section that contains the trays and/or packing to provide the necessary contact between the liquids falling downward and the vapors rising upward. The depropanizing section also includes one or more reboilers (such as reboiler 33) which heat and vaporize a portion of the liquids flowing down the column to provide the stripping vapors which flow up the column to strip the bottom liquid product, stream 78, of $C_3$ components and lighter components. Stream 72*b* enters depropanizer 32 at an intermediate feed position located between the absorbing section and the stripping section of depropanizer 32. The liquid portion of the heated stream commingles with liquids falling downward from the absorbing section and the combined liquid continues downward into the stripping section of depropanizer 32. The vapor portion of the heated stream rises upward through the absorbing section and is contacted with cold liquid falling downward to condense and absorb the $C_4$ components and heavier components.

The overhead vapor (stream 73) from depropanizer 32 enters reflux condenser 34 and is cooled by propane refrigerant from 59° F. [15° C.] to −33° F. [−36° C.] to condense it before entering reflux separator 35 at 260 psia [1,793 kPa(a)]. If there is any uncondensed vapor (stream 74), it is expanded to the operating pressure of demethanizer 28 by expansion valve 38 and returned to demethanizer 28 at a lower column feed point. In the simulation of FIG. 1, however, all of the overhead vapor is condensed and leaves reflux separator 35 in liquid stream 75. Stream 75 is pumped by pump 36 to a pressure slightly above the operating pressure of depropanizer 32, and a portion (stream 76) of stream 75*a* is then supplied as top column feed (reflux) to depropanizer 32 to absorb and condense the $C_4$ components and heavier components rising in the absorbing section of the column. The remaining portion (stream 77) contains the $C_3$ and lighter components stripped from distillation liquid stream 72. It is expanded to the operating pressure of demethanizer 28 by expansion valve 37, cooling stream 37*a* to −44° F. [−42° C.] before it is returned to demethanizer 28 at a lower column feed point, below the withdrawal point of distillation liquid stream 72.

The bottom liquid product from depropanizer 32 (stream 78) has been stripped of the $C_3$ and lighter components, and is predominantly $C_4$-$C_5$ hydrocarbons. It leaves the bottom of depropanizer 32 at 230° F. [110° C.] and is cooled to −20° F. [−29° C.] in heat exchanger 31 as described earlier. Stream 78*a* is further cooled to −35° F. [−37° C.] with propane refrigerant in heat exchanger 39 (stream 78*b*) and then expanded to the operating pressure of demethanizer 28 in expansion valve 40. The expanded stream 78*c* is then supplied to demethanizer 28 as reflux, entering at the top feed location at −35° F. [−37° C.]. The $C_4$-$C_5$ hydrocarbons in stream 78*c* act as an absorbent to capture the $C_2$+ components in the vapors flowing upward in the absorbing section of demethanizer 28.

In the stripping section of demethanizer 28, the feed streams are stripped of their methane and lighter components. The resulting liquid product (stream 71) exits the bottom of tower 28 at 24° F. [−4° C.] and is pumped to higher pressure in pump 29. The pumped stream 71*a* is then heated to 93° F. [34° C.] in heat exchanger 20 as described previously. The cold residue gas stream 68 leaves demethanizer 28 at −32° F. [−35° C.] and passes countercurrently to the incoming feed gas in heat exchanger 23 where it is heated to 32° F. [0° C.] (stream 68*a*) and in heat exchanger 20 where it is heated to 95° F. [35° C.] (stream 68*b*) as it provides cooling as previously described. The residue gas product then flows to the fuel gas distribution header at 165 psia [1,138 kPa(a)].

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Component | Stream 61 | Stream 62 | Stream 63 | Stream 64 | Stream 65 |
|---|---|---|---|---|---|
| Hydrogen | 833 | 823 | 10 | 814 | 9 |
| Methane | 2,375 | 2,225 | 150 | 1,980 | 245 |
| Ethylene | 115 | 95 | 20 | 60 | 35 |
| Ethane | 944 | 710 | 234 | 349 | 361 |

TABLE I-continued (FIG. 1)
Stream Flow Summary - Lb. Moles/Hr [kg moles/Hr]

| | | | | | |
|---|---|---|---|---|---|
| Propylene | 212 | 112 | 100 | 23 | 89 |
| Propane | 597 | 293 | 304 | 51 | 242 |
| Butylene/Butadiene | 135 | 36 | 99 | 2 | 34 |
| i-Butane | 78 | 23 | 55 | 2 | 21 |
| n-Butane | 166 | 39 | 127 | 2 | 37 |
| Pentanes+ | 46 | 5 | 41 | 0 | 5 |
| Totals | 5,577 | 4,431 | 1,146 | 3,348 | 1,083 |

| Component | Stream 72 | Stream 73 | Stream 75 | Stream 76 | Stream 77 |
|---|---|---|---|---|---|
| Hydrogen | 0 | 0 | 0 | 0 | 0 |
| Methane | 186 | 298 | 298 | 112 | 186 |
| Ethylene | 89 | 142 | 142 | 53 | 89 |
| Ethane | 836 | 1,336 | 1,336 | 500 | 836 |
| Propylene | 129 | 194 | 194 | 73 | 121 |
| Propane | 353 | 482 | 482 | 180 | 302 |
| Butylene/Butadiene | 239 | 24 | 24 | 9 | 15 |
| i-Butane | 111 | 18 | 18 | 7 | 11 |
| n-Butane | 396 | 16 | 16 | 6 | 10 |
| Pentanes+ | 220 | 0 | 0 | 0 | 0 |
| Totals | 2,569 | 2,515 | 2,515 | 941 | 1,574 |

| Component | Stream 78 | Stream 68 | Stream 71 |
|---|---|---|---|
| Hydrogen | 0 | 833 | 0 |
| Methane | 0 | 2,352 | 23 |
| Ethylene | 0 | 45 | 70 |
| Ethane | 0 | 109 | 835 |
| Propylene | 8 | 4 | 208 |
| Propane | 51 | 21 | 576 |
| Butylene/Butadiene | 224 | 22 | 113 |
| i-Butane | 100 | 12 | 66 |
| n-Butane | 386 | 29 | 137 |
| Pentanes+ | 220 | 4 | 42 |
| Totals | 995 | 3,501 | 2,076 |

| Recoveries* | | |
|---|---|---|
| Ethylene | 60.81% | |
| Ethane | 88.41% | |
| Propylene | 98.22% | |
| Propane | 96.57% | |
| Butanes+ | 84.03% | |
| Power | | |
| Inlet Gas Compression | 6,072 HP | [9,982 kW] |
| Refrigerant Compression | 5,015 HP | [8,245 kW] |
| Total Compression | 11,087 HP | [18,227 kW] |

*(Based on un-rounded flow rates)

Other Embodiments

In accordance with this invention, it is generally advantageous to design the absorbing (rectification) section of the demethanizer to contain multiple theoretical separation stages. However, the benefits of the present invention can be achieved with as few as two theoretical stages. For instance, all or a part of the reflux liquid (stream 78*c*) and all or a part of the expanded stream 64*a* can be combined (such as in the piping to the demethanizer) and if thoroughly intermingled, the vapors and liquids will mix together and separate in accordance with the relative volatilities of the various components of the total combined streams. Such commingling of the two streams, shall be considered for the purposes of this invention as constituting an absorbing section.

FIG. 2 displays another embodiment of the present invention that may be preferred in some circumstances. In the FIG. 2 embodiment, a portion (stream 66) of vapor stream 64 from separator 24 is expanded to an intermediate pressure by expansion valve 26 and then combined with cooled depropanizer bottoms stream 78*b* to form a combined stream 79. The combined stream 79 is cooled in heat exchanger 27 (stream 79*a*) by the cold demethanizer overhead stream 68, then expanded to the operating pressure of demethanizer 28 by expansion valve 40. The expanded stream 79*b* is then supplied as reflux to the top feed position of demethanizer 28. The remaining portion (stream 67) of vapor stream 64) is expanded to the tower operating pressure by work expansion machine 14, and the expanded stream 67*a* is supplied to the upper mid-column feed position on demethanizer 28.

Feed gas conditions, plant size, available equipment, or other factors may indicate that elimination of work expansion machine 14, or replacement with an alternate expansion device (such as an expansion valve), is feasible. Although individual stream expansion is depicted in particular expansion devices, alternative expansion means may be employed where appropriate. For example, conditions may warrant work expansion of the reflux stream (stream 78*b* or stream 79*a*).

When the inlet gas is leaner, separator 21 in FIGS. 1 and 2 may not be justified. In such cases, the feed gas cooling accomplished in heat exchangers 20 and 23 in FIGS. 1 and 2 may be accomplished without an intervening separator. The decision of whether or not to cool and separate the feed gas in multiple steps will depend on the richness of the feed gas, plant size, available equipment, etc. Depending on the quantity of heavier hydrocarbons in the feed gas and the feed gas pressure, the cooled feed stream 61*a* leaving heat exchanger 20 and/or the cooled stream 62*a* leaving heat exchanger 23 in FIGS. 1 and 2 may not contain any liquid (because it is above its dewpoint, or because it is above its cricondenbar), so that separator 21 and/or separator 24 shown in FIGS. 1 and 2 are not required.

The expanded liquid (stream 65*a* in FIGS. 1 and 2) need not be heated before it is supplied to the lower mid-column feed point on the distillation column. Instead, all or a portion of it may be supplied directly to the column. Any remaining portion of the expanded liquid may then be heated before it is fed to the distillation column.

In accordance with the present invention, the use of external refrigeration to supplement the cooling available to the inlet gas from other process streams may be employed, particularly in the case of a rich inlet gas. The use and distribution of separator liquids and demethanizer side draw liquids for process heat exchange, and the particular arrangement of heat exchangers for inlet gas cooling must be evaluated for each particular application, as well as the choice of process streams for specific heat exchange services.

In accordance with the present invention, the splitting of the vapor feed for the FIG. 2 embodiment may be accomplished in several ways. In the process of FIG. 2, the splitting of vapor occurs following cooling and separation of any liquids which may have been formed. The high pressure gas may be split, however, prior to any cooling of the inlet gas or after the cooling of the gas and prior to any separation stages. In some embodiments, vapor splitting may be effected in a separator.

It will also be recognized that the relative amount of feed found in each branch of the split vapor feed of the FIG. 2 embodiment will depend on several factors, including gas pressure, feed gas composition, the amount of heat which can economically be extracted from the feed, and the quantity of horsepower available. More feed to the top of the column may increase recovery while decreasing power recovered from the expander thereby increasing the compression horsepower requirements. Increasing feed lower in the column reduces the horsepower consumption but may also reduce product recovery. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position.

The present invention provides improved recovery of $C_2$ components, $C_3$ components, and heavier hydrocarbon components per amount of utility consumption required to operate the process. An improvement in utility consumption required for operating the demethanizer process may appear in the form of reduced power requirements for compression or re-compression, reduced power requirements for external refrigeration, reduced energy requirements for tower reboilers, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process or the separation of a gas stream containing methane and more volatile components, $C_2$ components, $C_3$ components, and heavier hydrocarbon components into a volatile residue gas fraction and a relatively less volatile fraction containing a major portion of said $C_2$ components, $C_3$ components, and heavier hydrocarbon components, in which process (a) said gas stream is cooled under pressure to provide a cooled stream;

(b) said cooled stream is expaned to lower pressure whereby it is further cooled; and (c) said further cooled stream is directed into a first distillation column and fractionated at said lower pressure whereby the components of said relatively less volatile fraction are recovered;

the improvement wherein (1) said further cooled expanded stream is directed to said first distillation column at a mid-column feed position;

(2) a distillation liquid stream is withdrawn from a region of said first distillation column below said mid-column feed position;

(3) said distillation liquid stream is heated, and thereafter directed into a second distillation column and fractionated into an overhead vapor stream and a bottom liquid stream;

(4) said overhead vapor stream is cooled to condense substantially all of it, thereby forming a condensed stream;

(5) said condensed stream is divided into a first portion and a second portion, whereupon said first portion is directed to said second distillation column at a top feed position;

(6) said second portion is directed to said first distillation column at a lower column feed position below said region wherein said distillation liquid stream is withdrawn from said first distillation column;

(7) said bottom liquid stream is cooled, thereby to supply at least a portion of the heating of step (3);

(8) said cooled bottom liquid stream is directed to said first distillation column at a top feed position;

(9) the quantities and temperatures of said feed streams to said second distillation column are effective to maintain the overhead temperature of said second distillation column at a temperature whereby said overhead vapor stream is predominantly $C_3$ hydrocarbon components and more volatile components, and said bottom liquid stream is predominatly $C_4$-$C_5$hydrocarbon components, and

(10) the quantities and temperatures of said feed streams to said first distillation column are effective to maintain the overhead temperature of said first distillation column at a temperature whereby the major portions of the components in said relatively less volatile fraction are recovered.

2. The process according to claim 1 wherein said gas stream is cooled sufficiently to partially condense it; and (a) said partially condensed gas stream is separated thereby to provide a vapor stream and at least one liquid stream;

(b) said vapor stream is expanded to said lower pressure and is supplied to said first distillation column at said mid-column feed position;

(c) at least a portion of said at least one liquid stream is expanded to said lower pressure and is supplied to said first distillation column at a lower mid-columnm feed position below said mid-column feed position; and (d) said distillation liquid stream is withdrawn from a region of said first distillation column below said mid-column feed position and above said lower mid-column feed position.

3. The process according to claim 1 wherein said cooled stream is divided into first and second streams; and (a) said second stream is expanded to said lower pressure and is supplied to said first distillation column at said mid-column feed position;

(b) said first stream is expanded to an intermediate pressure and thereafter combined with said cooled bottom liquid stream to form a combined stream;

(c) said combined stream is cooled and thereafter expanded to said lower pressure; and (d) said expanded cooled combined stream is directed to said first distillation column at said top feed position.

4. The process according to claim 2 wherein (a) said vapor stream is divided into first and second streams;

(b) said second stream is expanded to said lower pressure and is supplied to said first distillation column at said mid-column feed position;

(c) said first stream is expanded to an intermediate pressure and thereafter combined with said bottom liquid stream to form a combined stream;

(d) said combined stream is cooled and thereafter expanded to said lower pressure; and (e) said expanded cooled combined stream is directed to said first distillation column at said top feed position.

5. The process according to claim 2 or 4 wherein said expanded at least a portion of said at least one liquid stream is heated and thereafter supplied to said first distillation column at said another lower mid-column feed position below said mid-column feed position.

6. The process according to claim 1, 2, 3, or 4 wherein (1) said overhead vapor stream is cooled sufficiently to partially condense it;

(2) said partially condensed overhead vapor stream is separated thereby to provide a residual vapor stream and said condensed stream; and (3) said residual vapor stream is directed to said first distillation column at another lower column feed position below said region wherein said distillation liquid stream is withdrawn from said distillation column.

7. The process according to claim 5 wherein (1) said overhead vapor stream is cooled sufficiently to partially condense it;

(2) said partially condensed overhead vapor stream is separated thereby to provide a residual vapor stream and said condensed stream; and (3) said residual vapor stream is directed to said first distillation column at another lower column feed position below said region wherein said distillation liquid stream is withdrawn from said first distillation column.

8. In an apparatus for the separation of a gas stream containing methane and more volatile components, $C_2$ components, $C_3$ components, and heavier hydrocarbon components into a volatile residue gas fraction and a relatively less volatile fraction containing a major portion of said $C_2$ components, $C_3$ components, and heavier hydrocarbon components, in said apparatus there being (a) a first cooling means to cool said gas stream under pressure connected to provide a cooled stream under pressure;

(b) an expansion means connected to receive at least a portion of said cooled stream under pressure and expand it to a lower pressure, whereby said stream is further cooled; and (c) a first distillation column connected to receive said further cooled stream, said first distillation column being adapted to separate said further cooled stream into said volatile residue gas fraction and said relatively less volatile fraction;

the improvement wherein said further cooled expanded stream is directed to said first distillation column at a mid-column feed position, and said apparatus includes (1) liquid withdrawing means connected to said first distillation column to receive a distillation liquid stream from a region of said first distillation column below said mid-column feed position;

(2) heat exchange means connected to said liquid withdrawing means to receive said distillation stream and heat it;

(3) second distillation column connected to said heat exchange means to receive said heated distillation liquid stream and fractionate it into an overhead vapor stream and a bottom liquid stream;

(4) second cooling means connected to said second distillation column to receive said overhead vapor stream and cool it sufficiently to substantially condense it, thereby forming a condensed stream;

(5) dividing means connected to said second cooling means to receive said condensed stream and divide it into at least a first portion and a second portion;

(6) said dividing means connected to said second distillation column to supply said first portion to said second distillation column at a top feed portion;

(7) said dividing means being further connected to said first distillation column to supply said second portion to said first distillation column at a lower column feed position below said region where said liquid withdrawing means is connected to said first distillation column to withdraw said distillation liquid stream;

(8) said heat exchange means being further connected to said second distillation column to receive said bottom liquid stream and cool it, thereby to supply at least a portion of the heating of step (2),said heat exchange means being further connected to said first distillation column to supply said cooled bottom liquid stream to said first distillation column at a top feed position;

(9) first control means adapted to regulate the quantities and temperatures of said feed to streams to said second distillation column to maintain the overhead temperature of said second distillation column at a whereby said overhead vapor stream is predominantly $C_3$ hydrocarbon components and more volatile components, and said bottom liquid stream is predominantly $C_4$-$C_5$ hydrocarbon components; and

(10) second control means adapted to regulate the quantities and temperatures of said feed streams to said first distillation column to maintain the overhead temperature of said first distillation column at a temperature whereby the major portions of the components in said relatively less volatile fraction are recovered.

9. The apparatus according to claim 8 wherein said apparatus includes (a) said first cooling means being adapted to cool said gas stream under pressure sufficiently to partially condense it;

(b) separating means connected to said first cooling means to receive said partially condensed gas stream and separate it into a vapor stream and at least one liquid stream;

(c) said expansion means being connected to said separating means to receive said vapor stream and expand it to said lower pressure, said expansion means being further connected to said first distillation column to supply said expanded vapor stream to said first distillation column at said mid-column feed position;

(d) another expansion means connected to said separating means to receive at least a portion of said at least one liquid stream and expand it to said lower pressure, said another expansion means being further connected to said first distillation column to supply said expanded liquid stream to said first distillation column at a lower mid-column feed position below said mid-column feed position; and (e) said liquid withdrawing means connected to said first distillation column to receive a distillation liquid stream from a region of said first distillation column below said mid-column feed position and above said lower mid-column feed position.

10. The apparatus according to claim 8 wherein said apparatus includes (a) another dividing means connected to said first cooling means to receive said cooled stream and dividing it into first and second streams;

(b) said expansion means being connected to said another dividing means to receive said second stream and expand it to said lower pressure, said expansion means being further connected to said distillation column to supply said expanded second stream to said first distillation column at said mid-column feed position;

(c) another expansion means connected to said first dividing means to receive said first stream and expand it to an intermediate pressure;

(d) combining means connected to said another expansion means said heat exchange means to receive said expanded first stream and said cooled bottom liquid stream and form a combined stream;

(e) third cooling means connected to said combining means to receive said combined stream and cool it; and (f) further expansion means connected to said third cooling means to receive said cooled combined stream and expand it to said lower pressure, said further expansion means being further connected to said first distillation column to supply said expanded cooled combined stream to said first distillation column at said top feed position.

11. The apparatus according to claim 9 wherein (a) another dividing means connected to said separating means to receive said vapor stream and divide it into first and second streams;

(b) said expansion means being connected to said another dividing means to receive said second stream and expand it to said lower pressure, said expanded second stream to said first distillation column at said mid-column feed position;

(c) further expansion means connected to said first dividing means to receive said first stream and expand it to an intermediate pressure;

(d) combining means connected to said further expansion means and said heat exchange means to receive said expanded first stream and said cooled bottom liquid stream and form a combined stream;

(e) third cooling means connected to said combining means to receive said combined stream and cool it; and (f) additional expansion means connected to said third cooling means to receive said cooled combined stream and expand it to said lower pressure, said additional expansion means being further connected to said first distillation column to supply said expanded cooled combined stream to said first distillation column at said top feed position.

12. The improvement according to claim 8 wherein (1) said second cooling means is adapted to cool said overhead vapor stream sufficiently to partially condense it;

(2) a separating means is connected to said second cooling means to receive said partially condensed overhead vapor stream and separate it into a residual vapor stream and said condensed stream;

(3) said dividing means is adapted to be connected to said separating means to receive to said condensed stream; and (4) said separating means is connected to said first distillation column to supply said residual vapor stream to said first distillation column at another lower column feed position below said region where said liquid withdrawing means is connected to said first distillation column to withdraw said distillation liquid stream.

13. The apparatus according to claim 9 wherein (1) said second cooling means is adapted to cool said overhead vapor stream sufficiently to partially condense it;

(2) another separating means is connected to said second cooling means to receive said partially condensed overhead vapor stream and separate it into a residual vapor stream and said condensed stream;

(3) said dividing means is adapted to be connected to said another separating means to receive said condensed stream;and (4) said another separating means is connected to said first distillation column to supply said residual vapor stream to said first distillation column at another lower column feed position below said region where said liquid withdrawing means is connected to said first distillation column to withdraw said distillation liquid stream.

14. The apparatus according to claim 10 wherein (1) said second cooling means is adapted to cool said overhead vapor stream sufficiently to partially condense it;

(2) a separating means is connected to said second cooling means to receive said partially condensed overhead vapor stream and separate it into a residual vapor stream and said condensed stream;

(3) said second dividing means is adapted to be connected to said separating means to receive said condensed stream; and (4) said separating means is connected to said first distillation column to supply said residual vapor stream to said first distillation column at another lower column position below said region where said liquid withdrawing means is connected to said first distillation column to withdraw said distillation liquid stream.

15. The apparatus according to claim 11 wherein (1) said second cooling means is adapted to cool said overhead vapor stream sufficiently to partially condense it;

(2) another separating means is connected to said second cooling means to receive said partially condensed overhead vapor stream and separate it into a residual vapor stream and said condensed stream;

(3) said dividing means is adapted to be connected to said another separating means to receive condensed stream; and (4) said another separating means is connected to said first distillation column to supply said residual vapor stream to said first distillation column at another lower column feed position below said region where said liquid withdrawing means is connected to said first distillation column to withdraw said distillation liquid stream.

16. The apparatus according to claim 9, 11, 13, or 15 wherein a heating means is connected to said second expansion means to receive said expanded liquid stream and heat it,said heating means being further connected to said first distillation column to supply said heated expanded liquid stream to said first distillation column at said lower mid-column feed position.

* * * * *